US009463887B2

(12) United States Patent
Carmichael et al.

(10) Patent No.: US 9,463,887 B2
(45) Date of Patent: Oct. 11, 2016

(54) SCAVENGING OXYGEN

(75) Inventors: Adrian John Carmichael, Yorkshire (GB); Mark Frost, Derbyshire (GB); Andrew Stuart Overend, Lancashire (GB); Steven Burgess Tattum, Lancashire (GB)

(73) Assignee: ColorMatrix Holdings, Inc., Wilmington, DE (US)

( * ) Notice: Subject to any disclaimer, the term of this patent is extended or adjusted under 35 U.S.C. 154(b) by 623 days.

(21) Appl. No.: 13/983,327

(22) PCT Filed: Feb. 1, 2012

(86) PCT No.: PCT/GB2012/050211

§ 371 (c)(1),
(2), (4) Date: Aug. 2, 2013

(87) PCT Pub. No.: WO2012/104632

PCT Pub. Date: Aug. 9, 2012

(65) Prior Publication Data

US 2013/0323129 A1 Dec. 5, 2013

Related U.S. Application Data

(60) Provisional application No. 61/439,108, filed on Feb. 3, 2011.

(51) Int. Cl.
*B65B 31/04* (2006.01)
*B65D 81/26* (2006.01)

(52) U.S. Cl.
CPC ..... *B65B 31/04* (2013.01); *B65D 81/267* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,419,400 | A | 12/1968 | Hayhurst et al. | |
| 5,143,763 | A | 9/1992 | Yamada et al. | |
| 2004/0129554 | A1 | 7/2004 | Solis et al. | |
| 2010/0028499 | A1* | 2/2010 | Rule | A23L 3/3436 426/106 |

FOREIGN PATENT DOCUMENTS

| | | | |
|---|---|---|---|
| EP | 0 836 935 | | 4/1998 |
| JP | 03-284347 | A | 12/1991 |
| JP | 2011000869 | A | 1/2011 |
| WO | 99/28411 | A1 | 6/1999 |
| WO | WO 2008/090354 | | 7/2008 |
| WO | WO 2010/116194 | | 10/2010 |

* cited by examiner

*Primary Examiner* — Kaity Handal
(74) *Attorney, Agent, or Firm* — Fay Sharpe LLP

(57) ABSTRACT

A food container (2) includes a rigid thermoformed plastics carton (4) which holds a dry food 6 and is closed by a removable film closure (8). The film (8) incorporates a hydride which is arranged to generate hydrogen on contact with moisture. Additionally, the film (8) is arranged to have relatively high water vapour permeability and relatively low hydrogen gas permeability. In use, water vapour from air surrounding the container (2) passes into the film (8) and reacts with the hydride to generate hydrogen. Due to the relatively low hydrogen permeability of the film (8), the hydrogen is restricted from escaping from the container. Instead, the hydrogen then reacts with any oxygen within the container in a reaction catalysed by a catalyst also associated with the film closure (8), thereby to scavenge oxygen within the container (2) and protect the food (6) from oxidation.

16 Claims, 1 Drawing Sheet

SCAVENGING OXYGEN

BACKGROUND OF THE INVENTION

1. Field of the Invention

This invention relates to scavenging oxygen and particularly, although not exclusively, relates to scavenging oxygen in an assembly which contains a relatively dry and/or water free packaged material.

2. Description of Related Art

WO2008/090354 describes a beverage container including a shell made from a polymer and incorporating a catalyst, for example a palladium catalyst. A closure of the container incorporates a plug which includes a source of hydrogen, for example a hydride. In use, with a beverage in the container and the closure in position, the headspace in the container will be saturated with water vapour due to evaporation of water from the beverage. The vapour contacts the hydride associated with the plug and as a result the hydride produces molecular hydrogen which migrates into the polymer matrix of the shell and combines with oxygen which may have entered the container through its permeable walls. A reaction between the hydrogen and oxygen takes place, catalysed by the catalyst, and water is produced. Thus, oxygen ingressing the container is scavenged and the contents of the container are protected from oxidation.

The generation of the oxygen in the embodiments of WO2008/090354 is dependent on there being a water-containing material, for example beverage, within the container which can generate a water vapour pressure sufficient to trigger the production of hydrogen from the hydride. However, some dry materials are sensitive to oxygen and it is therefore desirable to package such oxygen-sensitive dry materials in low oxygen atmospheres and/or in packages where oxygen is scavenged, thereby to extend the shelf life of such dry materials.

It is an object of the present invention to address the above described problem.

SUMMARY OF THE INVENTION

According to a first aspect of the invention, there is provided an assembly comprising a high water permeability region having a relatively high water vapour permeability and being arranged to allow water to pass through in a direction towards a hydrogen generating means, wherein said hydrogen generating means is arranged to generate hydrogen after contact with water which has passed through said high water permeability region, wherein said assembly contains a relatively dry material.

Said dry material is preferably defined as a material which when in equilibrium in a sealed environment, exhibits a relative humidity measured at 25° C. and 1 atm, of less than 40%. Features of said dry material suitably refer to features of said dry material prior to any passage of water into the assembly.

Many food products, including flour, puffed corn, crackers, potato chips, and the like preferably exhibit relative humidities of 40% or less in order to maintain their sensory performance (such as crispness). At these low relative humidities, there may not be sufficient ambient moisture in a package to generate hydrogen as described in W2008/090354 and to completely consume oxygen ingressing through a package wall.

In a preferred embodiment, water which passes through to said hydrogen generating means may comprise or consist essentially of water vapour.

Whilst in some embodiments, said relatively dry material may contain only a small amount (e.g. 5 wt % or less, or even 1 wt % or less) of water, in other embodiments said relatively dry material may contain appreciable amounts of water but the water may not be free and/or available to evaporate from the relatively dry material (under the conditions in which the assembly is stored, for example at around 25° C.) and move towards the hydrogen generating means. For example, the relatively dry material may comprise a pharmaceutical capsule which includes a capsule wall from which little if any water is able to evaporate, but the capsule wall may enclose an aqueous liquid-based pharmaceutical formulation.

The assembly is suitably arranged to allow water (or preferably water vapour) to pass into the assembly from outside the assembly, for example from the atmosphere which surrounds the assembly. The atmosphere is suitably the ambient atmosphere such as would be found in a shop or a warehouse from which the assembly may be sold or stored. In order for water (or preferably water vapour) to pass through the high water permeability region, the mixing ratio (i.e. the grams of water per Kg of air) upstream of said high water permeability region is suitably higher than that downstream of the high water permeability region. The assembly suitably defines a confined and/or enclosed space, downstream of the high water permeability region. The atmosphere in the space suitably has a mixing ratio at Standard Ambient Temperature and Pressure (i.e. 25° C./101 kPa) (SATP) of less than 2 g/Kg, less than 1.5 g/Kg, less than 1.0 g/Kg, less than 0.5 g/Kg or preferably less than 0.3 g/Kg. Suitably, one or more of said mixing ratios apply immediately after completion of construction of the assembly, with said relatively dry material in position, suitably contained within the assembly. In addition, one or more of said mixing ratios applies for at least 1 week, at least 2 weeks, at least 1 month, at least 3 months and preferably at least 6 months after completion of construction of the assembly, provided said assembly remains in ambient air, suitably at a temperature no greater than 35° C. Ambient air typically has a mixing ratio of at least 6 g/Kg at 25° C. which is sufficient to cause generation of hydrogen by said hydrogen generating means.

Said relatively dry material is suitably contained within the assembly and may be removable therefrom. Said assembly suitably defines a package for the relatively dry material. Said relatively dry material may comprise a consumable material. However, it may comprise any material which is oxygen sensitive and/or in relation to which it is desirable to maintain the material in a relatively (e.g. relative to ambient air) low oxygen environment. In preferred embodiments, the dry material is for human or animal ingestion and may comprise a foodstuff, suitably a solid foodstuff, or a pharmaceutical. It is preferably a foodstuff. Suitable foodstuffs include but are not limited to cookies, crackers, nuts, cereals, tea leaves and tea bags, coffee beans and ground coffee, sugar, and flour In other embodiments, said relatively dry material may comprise a non-food, for example an item which includes electronics and/or any item it is desired to package in a relatively oxygen-free atmosphere.

Said relatively dry material suitably includes less than 20 wt %, preferably less than 10 wt %, more preferably less than 5 wt %, especially less than 2 wt % of water. As will be appreciated from the above, when said relatively dry material includes, for example, up to 20 wt % water, the majority if not substantially all of said water may not be free and/or available to evaporate from the relatively dry material.

Unless otherwise stated, water permeability described herein is measured using (American Society for Testing Materials Annual Book of Standards) ASTM procedure E96 Procedure E at 38° C. and relative humidity of 90%.

Said high water permeability region suitably has a water vapour permeability of more than about 0.02 g-mm/$m^2$-day.

Said high water permeability region may comprise one or a plurality of layers.

The water vapour permeability of a high permeability region comprising a plurality of layers can be calculated using the following equation:

$$P_T = \frac{L_T}{(L_A/P_A) + (L_B/P_B) + \ldots (L_n/P_n)}$$

Where:

$P_T$=total permeability $P_{A\text{-}n}$=permeability of individual layers $L_T$=total thickness of laminate $L_{A\text{-}n}$=thickness of individual layers Said high permeability region may have a thickness in the range of 0.001 mm to 10 mm.

Said high water permeability region preferably comprises a single layer of material.

Said high water permeability region preferably comprises a film.

Said high water permeability region suitably has, as described, a region of relatively high water vapour permeability. In addition, said region preferably has a relatively low hydrogen permeability. Thus, said region suitably has a hydrogen permeability of less than 50 cc-mm/$m^2$-atm-day.

The high water permeability region preferably defines an exposed outermost surface of the assembly, suitably so that the ambient atmosphere around the assembly has an uninterrupted passage to contact the region.

As described, the assembly includes a high water permeability region. Although substantially the entirety of the outer surface area of the assembly could be defined by said high water permeability region, preferably an area less than that of the entire outer surface of the assembly is defined by said high water permeability region. The Water Permeability Ratio (WPA) may be defined as $$WPA = \frac{\text{outer surface area } (m^2) \text{ of assembly defined by said high water permeability region}}{\text{total outer surface area } (m^2) \text{ of assembly}}$$

The WPA is preferably in the range of 0.9 to 0.001, and more preferably in the range of 0.5 to 0.002.

When the WPA is less than 1, some of the outer surface area (herein referred to as the "surrounding area") may be defined by a material other than those described for the high water permeability region. The area of the surrounding area is equal to (1-WPA) multiplied by the total outer surface area of assembly. The surrounding area preferably has a water vapour permeability of less than the water vapour permeability of the high water permeability region. The ratio of said water vapour permeability of said surrounding area to that of the high water permeability region is suitably less than 0.9, less than 0.8. In addition, said surrounding area preferably has a hydrogen permeability of no less than that of said high water permeability region.

Said hydrogen generating means preferably comprises an active material arranged to generate molecular hydrogen on reaction with moisture.

Said hydrogen generating means may comprise a matrix with which said active material is associated, for example embedded or preferably dispersed. Said matrix may comprise a matrix material, for example a polymeric matrix material, selected based on the solubility of moisture in the bulk polymer and which is suitably chemically inert to the active material. Suitable matrix materials have a water vapour permeability of greater than 0.1 g.mm/$m^2$.day, suitably greater than 0.2 g.mm/$m^2$.day, preferably greater than 0.4 g.mm/$m^2$.day, more preferably greater than 0.8 g.mm/$m^2$.day, and especially greater than 1.0 g.mm/$m^2$.day. Said matrix material may comprise a blend comprising, for example, at least two polymeric materials.

The water vapour permeability of said high water permeability region may be less than 5 g.mm/$m^2$.day, less than 4 g.mm/$m^2$.day or less than 3 g.mm/$m^2$.day. Suitable polymeric matrix materials include but are not limited to ethylene vinyl acetate, styrene-ethylene-butylene (SEBS) copolymers, Nylon 6, styrene, styrene-acrylate copolymers, polybutylene terephthalate, polyethylene terephthalate, polyethylene, and polypropylene.

The hydrogen generating means may be arranged to slowly release molecular hydrogen inside the assembly over an extended period of time. In the presence of a suitable catalyst, the molecular hydrogen will react with any oxygen present in the interior of the assembly and/or in a wall of the assembly. Preferably, the rate of hydrogen release is tailored to match the rate of oxygen ingress into the assembly. In addition, it is preferable for there to be an initial relatively rapid release of hydrogen, followed by a slow continual release over a period of months or even years. Furthermore, it is preferred that substantial release of hydrogen reliably begins only after a predetermined time. Finally, it is preferable that the substance releasing hydrogen does not adulterate the relatively dry material in the assembly.

The assembly suitably includes a catalyst for catalyzing a reaction between said molecular hydrogen and molecular oxygen. As a result, molecular oxygen in said assembly, for example which passes into said container through a wall thereof, may be scavenged, with water as a byproduct.

When the hydrogen generating means includes a matrix material with which said active material is associated, the ratio of the weight of active material to matrix material may be at least 0.01, preferably at least 0.02. Preferably, the matrix is a polymeric matrix and said active material is dispersed therein. In general, once an active material is dispersed into a polymer, the rate of release of hydrogen is limited by the permeation rate of water into the polymeric matrix and/or by the solubility of water in the chosen matrix. Thus, selection of polymeric materials based on the permeability or solubility of water in the polymer allows one to control the rate of release of molecular hydrogen from active materials.

The polymeric matrix may include at least 1 wt % of active material, preferably at least 2 wt %. The polymeric matrix may include less than 70 wt % of active material. Suitably, the polymeric matrix includes 1-60 wt %, preferably 2-40 wt % of active material, more preferably 4-30 wt % of active material. The balance of material in the polymeric matrix may predominantly comprise a said polymeric material. The aforementioned amounts of active material suitably refer to the sum of the amounts of active materials associated with said polymeric matrix. Thus more than one type of active material may be associated with said polymeric matrix.

Said active material may comprise a metal and/or a hydride. A said metal may be selected from sodium, lithium, potassium, magnesium, zinc or aluminum. A hydride may be inorganic, for example it may comprise a metal hydride or borohydride; or it may be organic.

Active materials suitable for the release of molecular hydrogen as a result of contact with water include but are not limited to: sodium metal, lithium metal, potassium metal, calcium metal, sodium hydride, lithium hydride, potassium hydride, calcium hydride, magnesium hydride, sodium borohydride, and lithium borohydride. While in a free state, all of these substances react very rapidly with water; however, once embedded into a polymeric matrix, the rate of reaction proceeds with a half-life measured in weeks to months.

Other active substances may include organic hydrides such as tetramethyl disiloxane and trimethyl tin hydride, as well as metals such as magnesium, zinc, or aluminum. Where the rate of reaction between the active material and water is too slow, the addition of hydrolysis catalysts and/or agents are explicitly contemplated. For example, the rate of hydrolysis of silicon hydrides may be enhanced by the use of hydroxide or fluoride ions, transition metal salts, or noble metal catalysts.

It is also contemplated that the active material may also be the polymeric matrix. For example, polymeric silicon hydrides such as poly(methylhydro)siloxane provide both a polymeric matrix and an active substance capable of releasing molecular hydrogen when in contact with moisture.

Selection of suitable active substances for incorporation into a polymeric matrix can be based on a number of criteria, including but not limited to cost per kilogram, grams of $H_2$ generated per gram of active substance, thermal and oxidative stability of the active substance, perceived toxicity of the material and its reaction byproducts, and ease of handling prior to incorporation into a polymeric matrix. Of the suitable active substances, sodium borohydride is exemplary because it is commercially available, thermally stable, of relatively low cost, has a low equivalent molecular weight, and produces innocuous byproducts (sodium metaborate).

In another preferred embodiment, said active material comprises calcium hydride. Calcium hydride suitably makes up at least 50 wt %, at least 60 wt %, at least 70 wt %, at least 80 wt % or at least 90 wt % of the total active substance(s) in said hydrogen-generating means which are arranged to release molecular hydrogen as a result of contact with water. In a preferred embodiment, calcium hydride represents more than 95 wt % or more than 98 wt % of the active substance(s) in said composition which are arranged to release molecular hydrogen as a result of contact with water. Preferably, calcium hydride is the only active substance in said composition which is arranged to release molecular hydrogen as a result of contact with water.

In a preferred embodiment, said hydrogen-generating means includes more than 16 wt % or more than 17 wt % of calcium hydride. Said composition may include 16.5-40 wt %, suitably 16.5 to 30 wt %, preferably 16.5 to 25 wt % of calcium hydride The particle size and particle size distribution described herein may be measured by methods such as those described in Size Measurement of Particles entry of Kirk-Othmer Encyclopedia of Chemical Technology, Vol. 22, $4^{th}$ ed., (1997) pp. 256-278, incorporated herein by reference. For example, particle size and particle size distributions may be determined using a Fisher Subsieve Sizer or a Microtrac Particle-Size Analyzer manufactured by Leeds and Northrop Company, or by microscope techniques, such as scanning electron microscopy or transmission electron microscopy.

The active material of said embodiments may be in the form of a finely divided powder, preferably with a median particle size from about 0.1 μm to 500 μm, more preferably from about 0.25 μm to 300 μm and especially from about 1 μm to 100 μm. [As used herein, a $d_{50}$ particle size is the median diameter, where 50% of the volume is composed of particles larger than the stated $d_{50}$, and 50% of the volume is composed of particles smaller than the stated $d_{50}$ value. As used herein, the median particle size is the same as the $d_{50}$ particle size.]

To exercise additional control on the rate and release of hydrogen from the active material of said embodiments, it may be useful to control the particle size distribution of the particles of the active material.

A range of particle size distributions may be useful. The particle size distribution, as used herein, may be expressed by the "span (S)," where S is calculated by the following equation:

$$S = \frac{d_{90} - d_{10}}{d_{50}}$$

where $d_{90}$ represents a particle size diameter in which 90% of the volume is composed of particles having a diameter smaller than the stated $d_{90}$; and $d_{10}$ represents a particle size in which 10% of the volume is composed of particles having a diameter smaller than the stated $d_{10}$.

Particle size distributions of the particles of active materials in which the span is less than 10, or less than 5 or less than 2 for example may be used. Alternatively, the particle size distribution (S) may range even broader, such as less than 15, less than 25 or less than 50.

The target particle size and distribution can be achieved via milling and classification techniques. These include dry and wet milling techniques such as jet-milling, ball-milling, bead-milling, pin-milling, ultrasonic milling and cryo-milling. When wet milling is used the liquid can be removed before the inclusion of the milled active material into the matrix or the liquid can incorporated with the milled active material into the matrix. The process can include additional additives such as dispersants, anti-caking agents and flow-aids to maintain the targeted particle size, particle size distribution and keep the product as a free flowing solid (see U.S. Pat. No. 5,182,046 and "Powders and solids: developments in handling and processing technologies" William Hoyle, 2001, Royal Society of Chemistry (Great Britain) and references therein for examples and use of such additives).

When the active material is incorporated into a construction, for example, a polymer film, the maximum dimension of a particle of the active material is preferably less than the smallest dimension in the construction. Preferably, it is one third the size or less than the smallest dimension in the construction; more preferably it is one fifth the size or less than the smallest dimension in the construction; and even more preferably it is one tenth the size or less than the smallest dimension in the construction.

Said hydrogen generating means is suitably provided downstream (e.g. in terms of water vapour flow into the assembly) of the high water permeability region. The distance between the hydrogen generating means and the closest outer surface of the assembly is preferably greater than the distance between the high water permeability region and the same outer surface. For the avoidance of doubt it will be appreciated that the high water permeability region may define an outer surface. The hydrogen generating means may be positioned between the high water permeability region and said relatively dry material.

Whilst the hydrogen generating means could be provided as a separate component of the assembly which is separate from and/or not directly attached to the high water permeability region, it is preferred that the high water permeability region and the hydrogen generating means are adjacent and/or are part of a fluid control structure. Such structure therefore may comprises the high water permeability region which preferably controls the flow of water into the assembly (and suitably restricts loss of hydrogen from the assembly) together with the hydrogen generating means which is arranged to generate hydrogen within the assembly. Suitably, the high water permeability region and hydrogen generating means are secured relative to one another.

Both the high water permeability region and hydrogen generating means may define thin layers which are secured to one another, optionally with an intermediate, for example tie and/or adhesive layer, positioned therebetween. Thus, the fluid control structure suitably includes a first layer which defines the high water permeability region and a second layer which defines the hydrogen generating means. The first layer suitably overlies 60-100%, preferably 90-100% of the area of a face of the second layer; and suitably, the second layer overlies 60-100%, preferably 90-100% of the area of the first layer. Preferably, faces of the first and second layers have substantially the same areas and are suitably directly superimposed.

Said fluid control structure may include a control means downstream of the hydrogen generating means—that is arranged so that hydrogen generating means is between the high water permeability region and the control means.

In order to facilitate the reaction between molecular hydrogen with molecular oxygen, a catalyst is preferably associated with the assembly. It is preferably arranged downstream of the hydrogen generating means. A large number of catalysts are known to catalyze the reaction of hydrogen with oxygen, including many transition metals, metal borides (such as nickel boride), metal carbides (such as titanium carbide), metal nitrides (such as titanium nitride), and transition metal salts and complexes. Of these, Group VIII metals are particularly efficacious. Of the Group VIII metals, palladium and platinum are especially preferred because of their low toxicity and extreme efficiency in catalyzing the conversion of hydrogen and oxygen to water with little or no byproduct formation. The catalyst is preferably a redox catalyst.

In order to maximize the efficiency of the oxygen scavenging reaction, it is preferable to locate the catalyst where reaction with oxygen is desired. For example, if the application requires that oxygen be scavenged before it reaches the relatively dry material in said assembly, incorporation of the catalyst in a side wall of the assembly is desirable. Conversely, if scavenging of oxygen already present in the assembly is desired, it is generally preferable to locate the catalyst near or in the interior of the assembly. Finally, if both functions are desired, catalyst may be located both in the interior of the assembly and in the walls. While the catalyst may be directly dispersed into the food or beverage, it is generally preferable that the catalyst be dispersed into a polymeric matrix. Dispersion of the catalyst into a polymeric matrix provides several benefits, including but not limited to minimization of food or beverage adulteration, minimization of catalyzed reaction between molecular hydrogen and food or beverage ingredients, and ease of removal and/or recycling of the catalyst from the food or beverage assembly.

A particular advantage of the present invention is that because of the extremely high reaction rates obtainable with a number of catalysts, very small amounts of catalyst may be required. An assembly may include 0.01 ppm to 1000 ppm, suitably 0.01 ppm to 100 ppm, preferably 0.1 ppm to 10 ppm, more preferably at least 0.5 ppm of catalyst relative to the weight of said assembly (excluding any contents (e.g. said relatively dry material) thereof). In preferred embodiments, 5 ppm or less of catalyst is included. Unless otherwise stated reference to "ppm" refer to parts per million parts by weight.

In general, the amount of catalyst required will depend on and can be determined from the intrinsic rate of catalysis, the particle size of the catalyst, the thickness of the walls of the assembly, the rates of oxygen and hydrogen permeation, and the degree of oxygen scavenging required.

In order to maximize the efficacy of the catalyst, it is preferred that the catalyst be well dispersed. The catalyst can be either homogenous or heterogeneous. For homogeneous catalysts it is preferred that the catalysts be dissolved in a polymer matrix at a molecular level. For heterogeneous catalysts, it is preferred that the average catalyst particle size be less than 1 micron, more preferred that average catalyst particle size be less than 100 nanometers, and especially preferred than the average catalyst particle size be less than 10 nanometers. For heterogeneous catalysts, the catalyst particles may be free-standing, or be dispersed onto a support material such as carbon, alumina, or other like materials.

The method of incorporation of the catalyst is not critical. Preferred techniques result in a well dispersed, active catalyst. The catalyst can be incorporated into the assembly at any time prior to, during, or after the introduction of the hydrogen generating means. The catalyst can be incorporated into a polymeric matrix during polymer formation or during subsequent melt-processing of the polymer. It can be incorporated by spraying a slurry or solution of the catalyst onto polymer pellets prior to melt processing. It can be incorporated by injection of a melt, solution, or suspension of the catalyst into pre-melted polymer. It may also be incorporated by making a masterbatch of the catalyst with polymer and then mixing the masterbatch pellets with polymer pellets at the desired level before injection molding or extrusion. In assemblies wherein the catalyst is located in the interior, the catalyst may be co-mingled with the active substance in the matrix of the hydrogen generating means.

In a preferred embodiment, the catalyst is incorporated into a wall of the assembly. It is preferably associated with, for example dispersed in, a polymer which defines at least part of the wall of the assembly. In a preferred embodiment, the catalyst is associated with material which defines at least 50%, preferably at least 75%, more preferably at least 90% of the area of the internal wall of the assembly.

In a preferred embodiment, the catalyst is distributed substantially throughout the entire wall area of an assembly, optionally excluding a closure thereof.

In one embodiment, the catalyst may be positioned either in an inner layer of a said high permeability region or the surrounding area. Optionally the catalyst may be positioned in both a said high permeability region and the surrounding area. The catalyst may also be positioned in an intermediate layer of a said high permeability region, the surrounding area, or both.

In one embodiment, the catalyst may be part of a catalyst assembly, for example a disc, which may be placed within the assembly and may be freely moveable there within.

Said assembly suitably contains less than 20 wt %, preferably less than 10 wt %, more preferably less than 5 wt %, less than 4 wt %, less than 3 wt %, or less than 2 wt % water, for example in any part thereof including in said relatively dry material. Said wt % suitably refers to the level prior to generation of hydrogen within the container by said hydrogen generating means.

In a preferred embodiment, said assembly comprises a package which contains said dry material. Said dry material is suitably arranged to be removed from the package. A said package suitably includes no intentional microscopic or macroscopic holes that provide for transport of small molecules between the interior and exterior of the package. Said package may include a permeable wall comprising of one or more polymers that have in the absence of any oxygen scavenging a permeability between about $6.5\times10^{-7}$ $cm^3$-cm/($m^2$-atm-day) and about $1\times10^4$ $cm^3$-cm/($m^2$-atm-day).

Said high water permeability region may be movable, for example detachable, to provide access to said dry material. When said assembly comprises a package, said high water permeability region may be part of a closure of the package. When the assembly includes a fluid control structure, at least part of (preferred substantially the whole of) said fluid control structure is movable to provide access to said dry material. Said high water permeability region and/or said fluid control structure may be components of a lidding foil of the package. Said package may include a container body, for example a tray and a removable closure for the body to allow access to the relatively dry material.

According to a second aspect of the invention, there is provided a method of protecting a relatively dry material from damage caused by contact with oxygen, the method comprising:

(i) selecting a relatively dry material;

(ii) arranging said relatively dry material within a confined and/or enclosed space thereby to define an assembly;

(iii) wherein said assembly comprises a high water permeability region having a relatively high water vapour permeability and being arranged to allow water to pass through in a direction towards a hydrogen generating means, wherein said hydrogen generating means is arranged to generate hydrogen after contact with water which has passed through said high water permeability region.

According to a third aspect, there is provided a method of making an assembly according to the first aspect, the method comprising steps (i) to (iii) of the method of the second aspect.

According to a fourth aspect, there is provided a method of generating hydrogen in an assembly according to the first aspect, the method comprising:

(i) placing the assembly in a region, for example atmosphere which includes water such that water (e.g. water vapour) passes through the relatively high water permeability region in a direction towards the hydrogen generating means of the assembly, thereby to generate hydrogen.

Any aspect of any invention described herein may be combined with any feature of any other aspect of any invention or embodiment described herein mutatis mutandis.

BRIEF DESCRIPTION OF THE DRAWINGS

Specific embodiments of the invention will now be described by way of example, with reference to the accompanying drawings, in which.

DETAILED DESCRIPTION OF THE INVENTION

Figure 1:
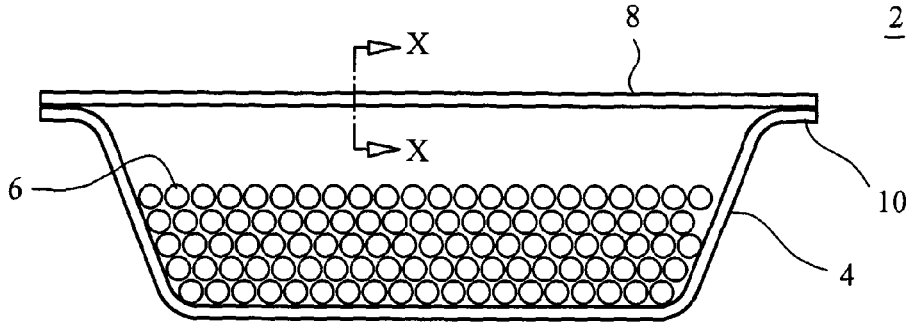
FIG. 1 is a schematic cross-section through a food container containing an oxygen-sensitive dry food.

In the figures, the same or similar parts are annotated with the same reference numerals.

The following materials are referred to hereinafter:

EVA—ethylvinylacetate copolymer (Ateva 1070) with vinyl acetate content of 9% and a melt flow index of 2.8 g/10 min (ASTM), was dried at 93° C. for approximately 2 hours in a forced air desiccant dryer to a moisture content of less than 100 ppm (Computrac MAX 2000L moisture Analyser).

Sodium Borohydride (Venpure SF) from Rohm & Hass was used as received.

Calcium hydride—(purity 99%) from Sigma-Aldrich

Ethylene vinyl acetate copolymer (15% vinylacetate content)—Elvax 550 supplied by DuPont.

Low density polyethylene (LDPE)—LD605BA supplied by ExxonMobil.

A food container 2 includes a rigid thermoformed plastics carton 4 which holds a dry food 6 and is closed by a removable film closure 8. The film 8 incorporates a hydride which is arranged to generate hydrogen on contact with moisture. Additionally, the film 8 is arranged to have relatively high water vapour permeability and relatively low hydrogen gas permeability. In use, water vapour from air surrounding the container 2 passes into the film 8 and reacts with the hydride to generate hydrogen. Due to the relatively low hydrogen permeability of the film 8, the hydrogen is restricted from escaping from the container. Instead, the hydrogen then reacts with any oxygen within the container in a reaction catalysed by a catalyst associated with the carton 4, thereby to scavenge oxygen within the container 2 and protect the food 6 from oxidation.

Further details are provided below.

The carton 4 suitably has a lower water permeability compared to that of the film 8 so that substantially no water passes therethrough. It suitably also has a relatively low oxygen and hydrogen permeability. It may comprise a single material that possesses these permeation properties, or it may be composed of a plurality of materials that in combination give these permeation properties. For example, a polypropylene/EVOH/polypropylene multilayer structure would be expected to possess both low oxygen and low moisture permeability.

The film 8 is heat sealed to lip 10 of the carton 4 in a conventional manner. Various forms of film 8 may be provided, as discussed below.

Figure 2:
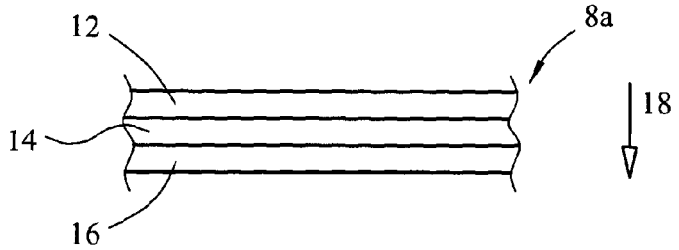
FIG. 2 is a cross-section, on an enlarged scale, along line X-X of FIG. 1.

Referring to FIG. 2, a three layer laminated film **8*a* is provided. It includes an outer layer 12 made from a high water permeability, low hydrogen permeability material. As a result, water vapour can pass through the layer in the direction of arrow 18, towards and into layer 14**. The outer layer may have a water permeability in the range of 0.1 g-mm/$m^2$-day to 0.5 g-mm/$m^2$-day and a hydrogen permeability in the range of 1 cc-mm/$m^2$-atm-day to 50 cc-mm/$m^2$-atm-day. An example of a suitable material is PET, which has a hydrogen permeability of about 40 cc-mm/$m^2$- atm-day and a moisture permeability of about 0.2 g-mm/$m^2$-day. Other suitable materials include nylon 6, nylon 6,6, cellophane, and poly(acrylonitrile).

Layer 14 incorporates a polymer and a hydride which is able to generate hydrogen on reaction with water vapour which passes into layer 12. Layer 14 may be prepared from pellets made as described in example 1 or example 2.

EXAMPLE 1

Sodium Borohydride/EVA Compound 2.4 kg of Sodium borohydride (8 wt %) was compounded with 27.6 kg of Ateva 1070 (92 wt %) on a 30 mm Werner-Pfleiderer twin screw extruder under a nitrogen blanket. The feed zone temperature was set at 26° C. and the other 10 zones of the extruder were set at 160° C. The compound was pelletised, dried and stored in a dry nitrogen atmosphere in a sealed foil bag.

EXAMPLE 2

2 kg of calcium hydride was compounded with 9.1 kg of LD605BA supplied by ExxonMobil on a 24 mm Prism TSE 24HC twin screw extruder fitted with a die-face cutter. The feed zone of the extruder was kept under a nitrogen blanket. The feed zone temperature was set at 50° C. and the other zones of the extruder were set at 140° C. except for the last few zones which tapered down in temperature: 130° C., 125° C. and 120° C. towards the die. The compound was pelletised and stored in a dry nitrogen atmosphere.

Layer 16 defines an inner layer of the film 8*a* which may contact the food 6 in use. Layer 16 has a relatively high hydrogen permeability (e.g. relatively high compared to the hydrogen permeability of layer 12) so that hydrogen generated in layer 14 can preferentially pass in the direction of arrow 18 into the headspace of container 2 where it can scavenge oxygen. In addition, layer 16 has a relatively low water permeability so as to concentrate the moisture in layer 14 and/or to restrict passage of moisture into the food 6; however, the amount of water generated generally is small compared to the amount of water present even in dry foods. The generation of water will occur at the location of the catalyst.

Layer 16 may have a water permeability in the range of 0.01 to 0.05 g-mm/$m^2$-day. Examples of suitable materials include high density polyethylene and polypropylene In the FIG. 2 embodiment, the carton 4 incorporates a catalyst, for example a palladium catalyst, capable of catalysing the reaction of hydrogen with oxygen to produce water. The catalyst may be dispersed in the polymeric material of the carton 4. Alternatively, the catalyst could be included in a separate structure associated with, for example secured within, the container 2.

Thus, in the FIG. 2 embodiment, water vapour is directed preferentially into layer 12, wherein it reacts with hydride to produce hydrogen which passes into the carton 4 where it scavenges oxygen in a catalysed reaction wherein water is produced. The water produced may pass back through the layer 16 back to the layer 14 wherein it may react with further hydride to generate further hydrogen and/or the hydride in layer 14 may act as a desiccant.

Figure 3:
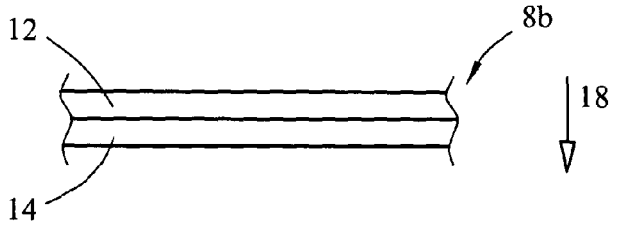
FIG. 3 is an alternative cross-section along line X-X.

The FIG. 3 embodiment comprises a film closure 8*b* which includes layers 12 and 14 as described for the FIG. 2 embodiment but does not include a layer 14. The FIG. 3 embodiment may also function similarly to the FIG. 2 embodiment, except that water produced in the carton 4 in the catalysed reaction between hydrogen produced in layer 14 and oxygen scavenged in the container 2 can more readily pass back into layer 14 where it may react with further hydride to generate further hydrogen and/or the hydride in layer 14 may act as a desiccant.

Figure 4:
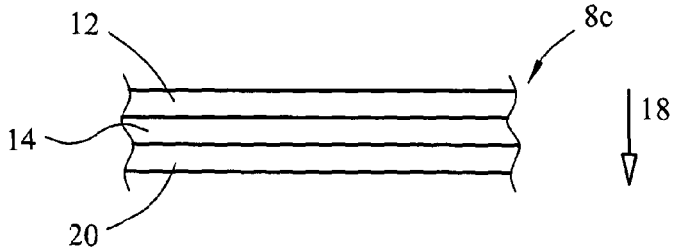
FIG. 4 is a cross-section along line X-X of an alternative embodiment.

The FIG. 4 embodiment comprises a film closure 8*c* which includes layers 12 and 14 as described for the FIGS. 2 and 3 embodiments but additionally includes a layer 20 which is arranged to absorb water produced in the carton 4 in the catalysed reaction between hydrogen and oxygen.

Figure 5:
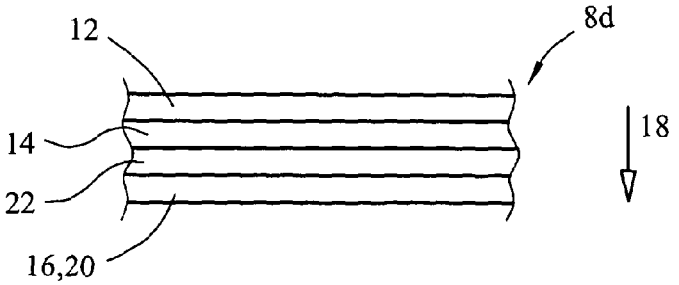
FIG. 5 is a cross-section along line X-X of a further alternative embodiment.

The FIG. 5 embodiment comprises a film closure 8*d* which includes layers 12 and 14 as described in the FIGS. 2 to 4 embodiments. In addition, it includes a layer 22 which incorporates a catalyst for catalysing the reaction between hydrogen and oxygen. Consequently, no such catalyst needs to be included in the polymeric material of carton 4 and, furthermore, water produced in the reaction may be more easily container within film 8*d* and/or away from the food 6 within the container. Film 8*d* may include a layer 16 or 20 adjacent the catalyst-containing layer 22. Such layers may prevent contact of the catalyst layer 22 with the food 6 in addition to fulfilling the function described above for layers 16, 20 in the FIGS. 2 and 4 embodiments.

In a further embodiment, catalyst may be included in layer 14 (which includes the hydride) in modifications to the FIGS. 2 to 4 embodiments described.

The various multi-layer films 8 described may be made by a combination of extrusion, co-extrusion and lamination. For example, layer 14 may be extruded using materials of examples 1 and 2, optionally including catalyst (when the layer additionally includes catalyst as in, for example, the FIG. 5 embodiment) and laminated to films of the other materials to define layers 12, 16, 20 etc.

It will be appreciated that the films 8 are arranged so that hydrogen generation is triggered by moisture in ambient air. Typically, this may be at least 30%, relative humidity measured at 23° C. In the present invention, the rate of hydrogen generation at a given temperature is roughly proportional to the relative humidity at that temperature.

Furthermore, it should be appreciated that films 8 are exposed to the ambient air in use and are not covered by a cap or other low water permeability material. Thus, in use, there is suitably an uninterrupted passage for moist air to pass from the atmosphere to the film 8.

A container incorporating a film 8 and/or catalyst as described above may be of any desired shape. It may be in the form of a jar, tray, cup, jug, bag, pouch or bottle. A film 8 of the type described could define substantially the entirety of the outer surface area of the container (in which case a tray 4 or the like of a different material need not be provided). Such an arrangement may be particularly relevant when the film 8 includes an inner layer which is relatively water impermeable. In other embodiments, a film 8 may define a lower percentage of the outer surface area of the container, for example as in FIG. 1. Alternatively, a body of a jar may be made of one material which does not include any means of hydrogen generation (e.g. no hydride is included) and a closure of the jar includes one of the structures of examples 2 to 5.

A closure of the type described, for example for a jar (or the like) may be releasably securable to a container. Thus, the closure may be replaced after removal and it may continue scavenging oxygen.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An assembly comprising a film closure, the film closure comprising: a high water permeability region comprised of a first thin layer having a relatively high water vapour permeability and being arranged to allow water to pass through in a direction towards a hydrogen generating means, wherein said hydrogen generating means comprises a second thin layer which is arranged downstream of the first thin layer, the second thin layer being arranged to generate hydrogen after contact with water which has passed through said high water permeability region, said assembly further comprising a catalyst disposed in a third thin layer downstream of the second thin layer for catalyzing a reaction between said hydrogen and molecular oxygen, and wherein said assembly contains a relatively dry packaged material.

2. An assembly according to claim 1, wherein said dry material is a material which, when in equilibrium in a sealed environment, exhibits a relative humidity measured at 25° C. and 1 atm, of less than 40%.

3. An assembly according to claim 1, wherein said assembly defines an enclosed space, downstream of the high water permeability region, and the atmosphere in the space has a mixing ratio at Standard Ambient Temperature and Pressure of less than 2 g/Kg.

4. An assembly according to claim 1, wherein said high water permeability region suitably has a water vapour permeability of more than 0.02 g-mm/$m^2$-day and less than 5 g-mm/$m^2$-day.

5. An assembly according to claim 1, wherein said high water permeability region has a hydrogen permeability of less than 50 cc-mm/$m^2$-atm-day.

6. An assembly according to claim 1, wherein the Water Permeability Ratio (WPA) is defined as $$WPA = \frac{\text{outer surface area } (m^2) \text{ of assembly defined by said high water permeability region}}{\text{total outer surface area } (m^2) \text{ of assembly}}$$

and said WPA is in the range of 0.9 to 0.001.

7. An assembly according to claim 1, wherein said hydrogen generating means comprises an active material arranged to generate molecular hydrogen on reaction with moisture.

8. An assembly according to claim 7, wherein said hydrogen generating means comprises a matrix with which said active material is dispersed, wherein said matrix comprises a polymeric matrix material.

9. An assembly according to claim 8, wherein said polymeric matrix material is selected from the group comprising ethylene vinyl acetate, styrene-ethylene-butylene (SEBS) copolymers, Nylon 6, styrene, styrene-acrylate copolymers, polybutylene terephthalate, polyethylene terephthalate, polyethylene, and polypropylene.

10. An assembly according to claim 7, wherein said active material comprises a metal and/or a hydride.

11. An assembly according to claim 1, wherein the first and second thin layers are part of a fluid control structure and wherein said thin layers are secured relative to one another, optionally with an intermediate layer positioned therebetween.

12. An assembly according to claim 11, wherein at least part of said fluid control structure is removable to provide access to the dry material.

13. An assembly according to claim 11, wherein said fluid control structure is a component of a lidding foil of a package defined by said assembly.

14. An assembly according to claim 1, wherein said high water permeability region is movable to provide access to the dry material.

15. A method of protecting a relatively dry packaged material from damage caused by contact with oxygen, the method comprising:

(i) selecting a relatively dry material;

(ii) arranging said relatively dry material within a confined and/or enclosed space thereby to define an assembly;

(iii) wherein said assembly comprises a film closure, the film closure comprising: a high water permeability region comprised of a first thin layer having a relatively high water vapour permeability and being arranged to allow water to pass through in a direction towards a hydrogen generating means, wherein said hydrogen generating means comprises a second thin layer which is arranged downstream of the first thin layer, the second thin layer being arranged to generate hydrogen after contact with water which has passed through said high water permeability region, said assembly further comprising a catalyst disposed in a third thin layer downstream of the second thin layer for catalyzing a reaction between said hydrogen and molecular oxygen.

16. A method of making the assembly described in claim 1, the method comprising:

(i) selecting a relatively dry material;

(ii) arranging said relatively dry material within a confined and/or enclosed space thereby to define an assembly;

(iii) wherein said assembly comprises a film closure, the film closure comprising: a high water permeability region comprised of a first thin layer having a relatively high water vapour permeability and being arranged to allow water to pass through in a direction towards a hydrogen generating means, wherein said hydrogen generating means comprises a second thin layer which is arranged downstream of the first thin layer, the second thin layer being arranged to generate hydrogen after contact with water which has passed through said high water permeability region, said assembly further comprising a catalyst disposed in a third thin layer downstream of the second thin layer for catalyzing a reaction between said hydrogen and molecular oxygen.

* * * * *